United States Patent [19]

Wolff

[11] Patent Number: 5,050,828

[45] Date of Patent: Sep. 24, 1991

[54] REMOVABLE SIGN POST ASSEMBLY

[76] Inventor: Curtis E. Wolff, Rte. 2, Box 71, Aurora, Nebr. 68818

[21] Appl. No.: 510,180

[22] Filed: Apr. 17, 1990

[51] Int. Cl.[5] ..... A45F 3/44

[52] U.S. Cl. ..... 248/156; 40/606; 248/545

[58] Field of Search ..... 248/160, 156, 545, 530, 248/533; 40/610, 606, 607, 608, 668; 52/725, 726; 404/10, 11, 9; 403/306, 308; 256/DIG. 5

[56] References Cited

U.S. PATENT DOCUMENTS

| | | | |
|---|---|---|---|
| 558,365 | 4/1896 | Duggan | 40/668 |
| 1,268,167 | 6/1918 | Shoecraft . | |
| 1,345,974 | 7/1920 | Watts . | |
| 3,250,032 | 5/1966 | Gal | 40/606 |
| 3,346,126 | 10/1967 | Bloom | 211/192 |
| 3,875,720 | 4/1975 | Russell | 52/725 |
| 4,032,248 | 6/1977 | Parduhn | 404/10 |
| 4,104,000 | 8/1978 | Fleischmann | 403/306 X |
| 4,235,034 | 11/1980 | Black | 40/607 |
| 4,483,506 | 11/1984 | Litwiller | 248/545 |
| 4,524,533 | 6/1985 | Still | 40/607 |
| 4,858,876 | 8/1989 | Moreno | 248/545 |

*Primary Examiner*—J. Franklin Foss

*Attorney, Agent, or Firm*—Zarley, McKee, Thomte, Voorhees & Sease

[57] ABSTRACT

A removable sign post is described comprising a metal lower post member which is driven into the ground with an upper post member being selectively vertically adjustably mounted thereon. The upper post member has a pair of locking lugs at its lower end which extend through a pair of openings formed in the lower post member and which are secured thereto by means of a locking bar. The upper post member includes at least a pair of vertically spaced projections extending therefrom which are adapted to pierce a sign member positioned thereon and to maintain the same thereon.

2 Claims, 2 Drawing Sheets

REMOVABLE SIGN POST ASSEMBLY

BACKGROUND OF THE INVENTION

This invention relates to a removable sign post and more particularly to a removable sign post comprised of upper and lower post members with the upper post member being removably secured to the lower post member.

Many types of removable sign posts have been previously described. It is an advantage to be able to permanently mount a lower post portion in the ground and to be able to removably secure an upper post portion thereto. For example, in field tests of different varieties of seed corn or the like, sign posts are normally positioned at the end of the rows with the signs thereon indicating the particular variety of seed corn being grown adjacent the sign post. If the sign posts are of one piece construction, the sign post must be positioned in the ground each spring and removed therefrom prior to harvesting. The removable sign posts of which the inventor herein is aware are not durable or are not convenient to use. Further, the conventional removable sign posts do not have any convenient means for attaching a paper, cardboard or plastic sign member thereto. Additionally, the conventional removable sign posts of which the inventor is aware are expensive to manufacture.

It is therefore a principal object of the invention to provide an improved removable sign post.

A further object of the invention is to provide a removable sign post assembly comprised of a lower post member which remains in the ground and which is adapted to have an upper post assembly quickly and easily secured thereto.

Another object of the invention is to provide a sign post assembly including means enabling a paper, cardboard or plastic sign member to be quickly and easily attached thereto.

Still another object of the invention is to provide a removable sign post assembly comprised of upper and lower post members wherein the lower post member is constructed of a steel material to enable it to be driven into the ground and whereon the upper post member is constructed of an economical and durable plastic material.

These and other objects of the invention will be apparent to those skilled in the art.

SUMMARY OF THE INVENTION

Figure 1:
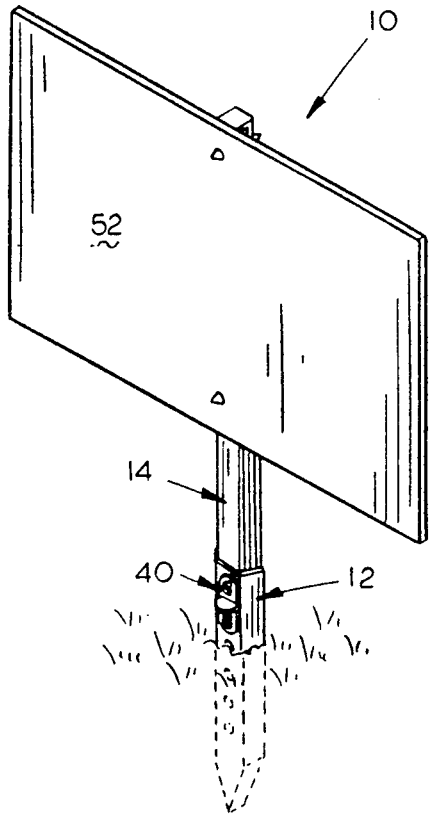
FIG. 1 is a perspective view of the sign post of this invention mounted in the ground.
Figure 2:
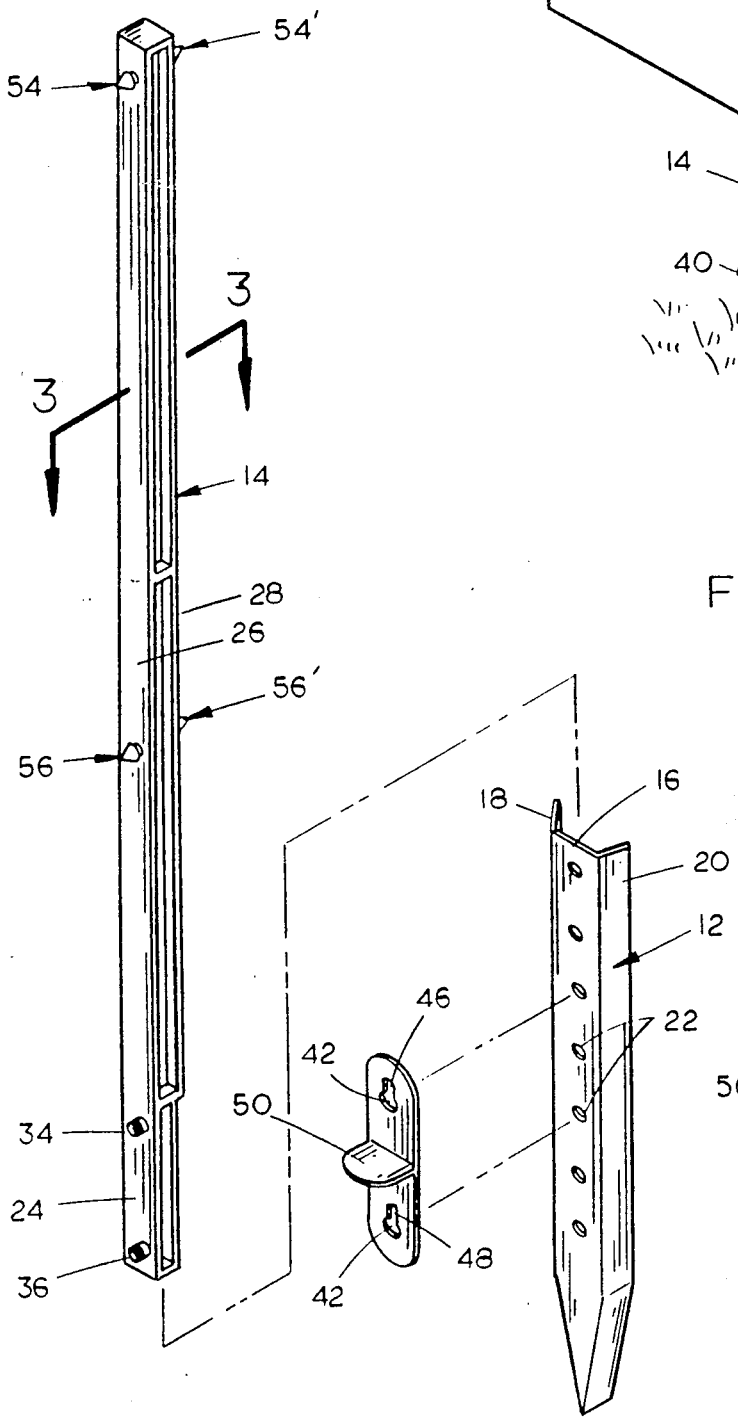
FIG. 2 is an exploded perspective view of the sign of this invention.
Figure 3:
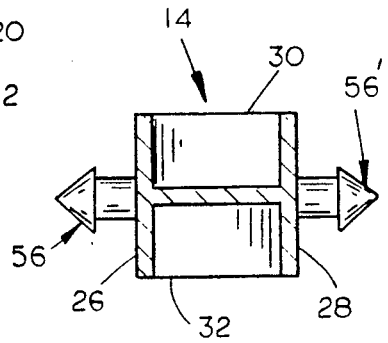
FIG. 3 is an enlarged sectional view as seen on lines 3—3 of FIG. 2.
Figure 4:
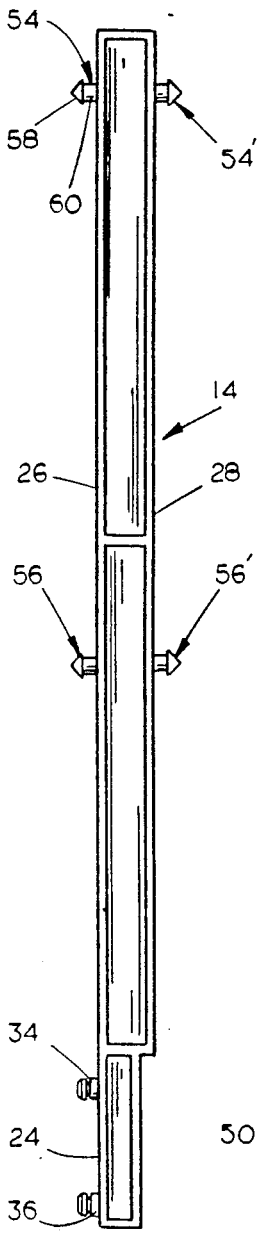
FIG. 4 is a side view of the upper post member.

A removable sign post assembly comprising a metal lower post member which is driven into the ground so that the upper end thereof is positioned slightly above ground level. An upper post member, preferably constructed of a plastic material, is removably secured to the upper end of the lower post member by means of a locking bar assembly. The upper post member has at least a pair of vertically spaced projections which extend therefrom which are adapted to pierce through a sign member and to maintain the sign member on the upper post member.

DESCRIPTION OF THE PREFERRED EMBODIMENT

The sign post assembly of this invention is referred to generally by the reference numeral 10 and includes a lower post portion 12 and an upper post portion 14. Lower post portion 12 is preferably of metal construction and includes a web portion 16 having side portions 18 and 20 extending therefrom. Web portion 16 is provided with a plurality of vertically spaced openings 22 formed therein. In use, lower post portion 12 is driven into the ground so that the upper end thereof protrudes slightly above ground level as illustrated in the drawings.

Upper post portion 14 is preferably constructed of a plastic material and has a lower end portion 24 having a cross-section as illustrated in the drawings to enable it to be received between the side portions 18 and 20 of lower post portion 12. More specifically, upper post portion 14 includes a front wall 26, back wall 28, and sides 30 and 32. Lower post portion 12 includes a pair of vertically spaced locking lugs 34 and 36 which protrude forwardly from front wall 26. As seen in the drawings, the locking lugs 34 and 36 each have a tapered head portion 37 to enable the locking lugs to be easily inserted through a pair of the openings 22 in lower post portion 12. Locking lugs 34 and 36 are each provided with recessed portions 38 as seen in the drawings.

Upper post portion 14 is secured to lower post portion 12 by simply positioning the lower end of upper post portion 14 between the side portions 18 and 20 so that the locking lugs 34 and 36 extend through a pair of the openings 22. Locking bar or clip 40 is then utilized to securely lock upper post portion 14 to the lower post portion 12 as will now be described. Locking bar 40 includes a pair of openings 42 and 44 having slots 46 and 48 extending therefrom. Handle or gripping portion 50 protrudes outwardly from the locking bar 40 to permit the manual manipulation of the locking bar.

When the locking lugs 34 and 36 have been extended through a pair of the openings 22, the locking bar is positioned so that the ends of the locking lugs 34 and 36 extend through the openings 42 and 44 respectively. The locking bar 40 is then moved downwardly so that the slots 46 and 48 receive the recessed portions 38 on the locking lugs 34 and 36 respectively, thereby positively maintaining the upper post portion on the lower post portion.

Figure 5:
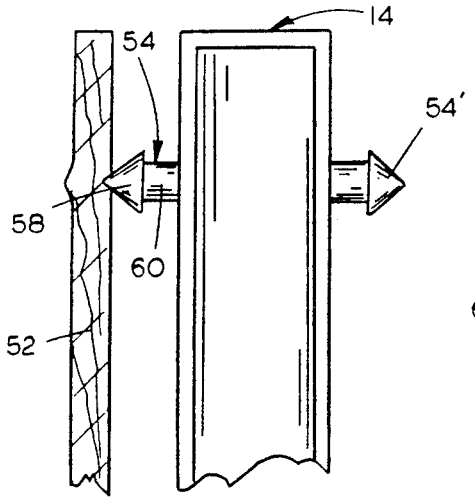
FIG. 5 is a side view of the upper portion of the upper post member illustrating the manner in which a sign member is secured thereto.
Figure 6:
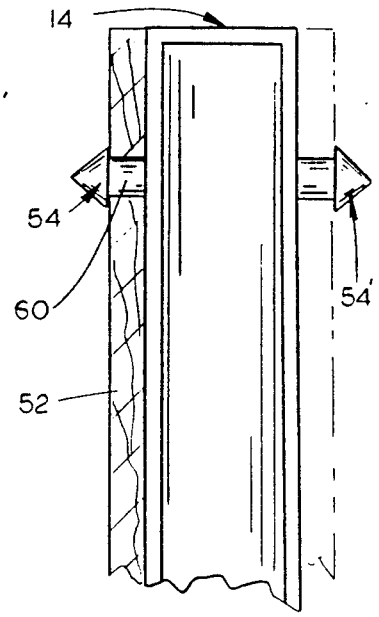
FIG. 6 is a view similar to FIG. 5 except that the sign member has been mounted thereon with the broken lines indicating the alternate position of the sign member.
Figure 7:
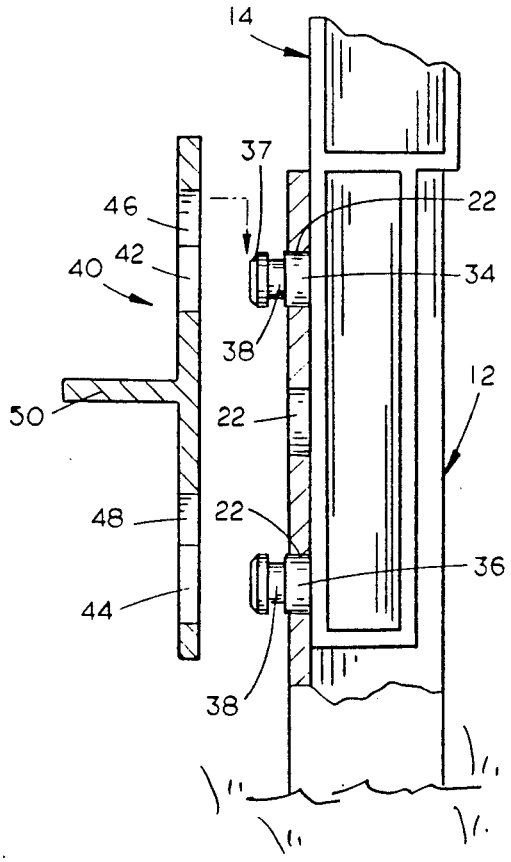
FIG. 7 is a sectional view illustrating the manner in which the locking bar is initially positioned to connect the upper and lower post members.
Figure 8:
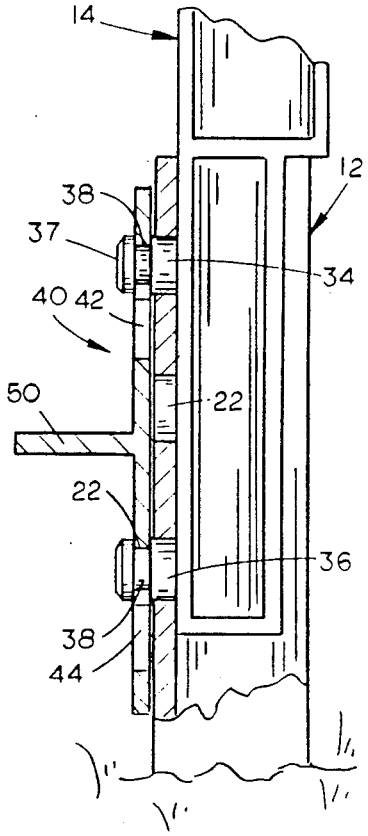
FIG. 8 is a view similar to FIG. 7 except that the locking bar has been positioned in its locking position.

To facilitate the convenient attachment of a cardboard, paper or plastic sign member 52 thereto, upper post portion is provided with a pair of vertically spaced projections 54 and 56 having a tapered head portion 58 on the outer end thereof which is larger than the shank portion 60 thereof. The sign 52 is easily secured to the upper post portion, by simply forcing the tapered head portions 58 through the material of the sign member as seen in FIG. 5. The tapered head portions 58 tend to create an opening in the sign material which is slightly less than the diameter of the head portions 58 so that the sign member will be maintained on the shank portion 60 inwardly of the head portions 58 as seen in FIG. 5. The sign member 52 is not only quickly and easily mounted on the sign post but may be conveniently removed therefrom if so desired. Upper post portion is also provided with a pair of vertically spaced projections 54' and 56' which protrude rearwardly from rear wall 28 to permit a sign to be secured thereto if desired.

Thus it can be seen that a novel sign post has been described which accomplishes at least all of its stated objectives. The upper post portion may be removed from the lower post portion with the lower post portion being left in the ground in such a manner so that it will not interfere with normal field operation.

The upper post portion is quickly and easily attached to the lower post portion and the sign member is quickly and easily attached to the upper sign portion. The upper post portion 14, by being constructed of a cheap plastic material, results in the overall cost of the sign post being less than if a steel post were utilized. The lower post portion 12, by being constructed of a steel material, may be driven into the ground without damaging the same. The upper post portion 14 is selectively vertically adjustably mounted on the lower post portion thereby giving the apparatus increased versatility. The locking bar 40 permits the upper post portion 14 to be quickly and easily secured to the lower post portion 12 while yet maintaining the upper post portion 14 on the lower post portion 12 in a secure manner.

I claim:

1. A removable sign post assembly, comprising, a vertically disposed lower post portion having upper and lower ends adapted to be positioned in the ground so that its upper end is positioned above ground level, said lower post portion having a generally U-shaped cross-section defined by a web portion having side portions extending therefrom, said web portion having a plurality of vertically spaced openings formed therein adjacent the upper end of said lower post portion, an upper post portion having upper and lower ends and front and back walls, the lower end of said upper post portion being removably received between said side portions of said lower post portion adjacent one side of said web position, said lower end of said upper post portion having at least two vertically spaced locking lugs extending horizontally from the front wall thereof through a pair of openings in said web portion, said locking lugs having outer end portions which are positioned outwardly of said web portion, said locking lugs having an enlarged head portion on the outer end portions;

a locking bar means removably mounted on the outer ends of said locking lugs for selectively removably maintaining said upper post portion on said lower post portion, said locking bar means including a pair of vertically spaced openings having vertical slots extending upwardly therefrom, said openings having a diameter greater than the head portions to receive said head portions therethrough, said slots having a width less than the diameter of the head portions to prevent horizontal movement of the locking bar means off of said locking lugs;

said locking bar means having a horizontally extending handle means projecting outwardly from said locking bar means, for vertically moving said locking bar means on said locking lugs;

means on said upper post portion for securing a sign thereto;

said means for securing the sign to said upper post portion comprising at least a first pair of vertically spaced projections on said front wall having enlarged, tapered head portions adapted to pierce through a sign and maintain the sign thereon.

2. The sign post of claim 1, further comprising a second pair of vertically spaced projections on said back wall diametric to said first projections, said second projections having enlarged, tapered head portions adapted to pierce through a sign and maintain the sign thereon.

* * * * *